US005244336A

United States Patent [19]

Engler et al.

[11] Patent Number: 5,244,336

[45] Date of Patent: Sep. 14, 1993

[54] MOBILE LIFTING APPARATUS WITH FORK ATTACHMENT

[75] Inventors: Edgar D. Engler, Caps Coral, Fla.; Melvin G. Stapel, Brookfield, Wis.

[73] Assignee: Riggers Manufacturing Co, Inc., Franksville, Wis.

[21] Appl. No.: 757,542

[22] Filed: Sep. 11, 1991

[51] Int. Cl.[5] ..... B66F 9/10

[52] U.S. Cl. ..... 414/642; 212/195; 212/218; 414/607; 414/718; 414/629; 187/9 R

[58] Field of Search ..... 414/607, 608, 785, 718, 414/628, 629, 639, 640, 641, 642, 652, 653, 654, 655, 656, 659, 663, 664, 668; 254/93 R, 93 VA; 187/9 R, 9 E; 212/195, 218, 203, 268, 220, 221

[56] References Cited

U.S. PATENT DOCUMENTS

| | | | |
|---|---|---|---|
| 4,289,442 | 9/1981 | Stevens | 414/629 |
| 4,382,743 | 5/1983 | Newell | 414/718 X |
| 4,763,800 | 8/1988 | Engler et al. | 212/195 |

FOREIGN PATENT DOCUMENTS

| | | | |
|---|---|---|---|
| 2731942 | 2/1979 | Fed. Rep. of Germany | 414/607 |
| 2520715 | 8/1983 | France | 414/607 |
| 8201363 | 4/1982 | PCT Int'l Appl. | 414/629 |

*Primary Examiner*—Frank E. Werner

*Attorney, Agent, or Firm*—Reinhart, Boerner, Van Deuren, Norris & Rieselbach

[57] ABSTRACT

A mobile lifting apparatus having an extendable boom assembly supported by a plurality of hydraulic cylinders extending upwardly from a wheeled chassis, and further having a fork attachment coupled to the extendable boom assembly. The fork attachment is configured to engage palletized loads and permits such loads to be raised and transported upon extension of the hydraulic cylinders. The fork attachment includes a buttress assembly that remains relatively stationary as the boom assembly is horizontally extended and retracted. The fork assembly further includes a pair of forks that are pivotal relative to the buttress assembly around a generally horizontal axis. The forks are coupled to the horizontally extendable portion of the boom assembly so that extension and retraction of the boom pivots the forks to change the angular orientation of the forks relative to horizontal. Such angular movement of the forks facilitates engagement and disengagement of the forks with the palletized load.

3 Claims, 2 Drawing Sheets

MOBILE LIFTING APPARATUS WITH FORK ATTACHMENT

BACKGROUND OF THE INVENTION

This invention relates generally to mobile lifting apparatus and, more particularly, to a fork attachment for a lift vehicle of the "boom truck" type.

One particularly versatile kind of mobile lifting apparatus is the type having a pair of horizontal, extendable booms supported by vertical hydraulic cylinders that are carried on a self-propelled chassis. Such an apparatus, which is exemplified by the "boom truck" mobile lifting apparatus manufactured and distributed by Riggers Manufacturing Co., Inc., of Franksville, Wis., is described in U.S. Pat. No. 4,763,800. Such an apparatus provides a low profile machine that can lift a load vertically and transport it horizontally even where the overhead clearance is extremely limited. Because the horizontal booms are themselves extendable, loads can also be lifted and placed ahead of the apparatus in places where the apparatus itself cannot be driven. Loads can even be carried atop the booms, in effect using the apparatus as a gantry or jack. In many ways, the versatility of the machine is limited only by the imagination of the operators and riggers who call upon the machine to perform various tasks.

Although highly versatile, there are, nevertheless, certain tasks that the "boom truck" type of mobile lifting apparatus has, heretofore, been unable to perform easily and quickly. One such task is lifting and transporting loads that are carried on pallets. Although slings can be rigged to lift such Palletized loads with a conventional "boom truck," this requires additional labor and in large measure negates the benefits and convenience of palletizing the load in the first place.

SUMMARY OF THE INVENTION

The invention provides a mobile lifting apparatus having a wheeled chassis, a plurality of substantially vertically oriented hydraulic cylinders mounted on the chassis, a pair of substantially horizontal, substantially parallel extendable booms supported by the vertically oriented hydraulic cylinders, an engine for driving the wheeled chassis and powering the hydraulic cylinders and the extendable booms, and a fork attachment supported by the extendable booms.

The invention also provides a fork attachment for a mobile lifting apparatus of the type having an extendable boom assembly supported by a plurality of substantially vertical hydraulic cylinders. The fork attachment comprises a pair of forks, each of which includes a substantially vertical upper portion and a substantially horizontal lower portion.

The fork attachment further includes structure for coupling the upper portions of the forks of the extendable boom assembly so that the forks are raised and lowered with the boom assembly as the hydraulic cylinders are extended and retracted. The fork attachment further includes a structure responsive to extension and retraction of the extendable boom assembly for varying the angular orientation of the lower portions of the forks relative to horizontal in response to extension and retraction of the extendable boom.

BRIEF DESCRIPTION OF THE DRAWINGS

The features of the present invention which are believed to be novel are set forth with particularity in the appended claims. The invention, together with the further objects and advantages thereof, may best be understood by reference to the following description taken in conjunction with the accompanying drawings, wherein like reference numerals identify like elements, and wherein:

DESCRIPTION OF THE PREFERRED EMBODIMENT

Figure 1:
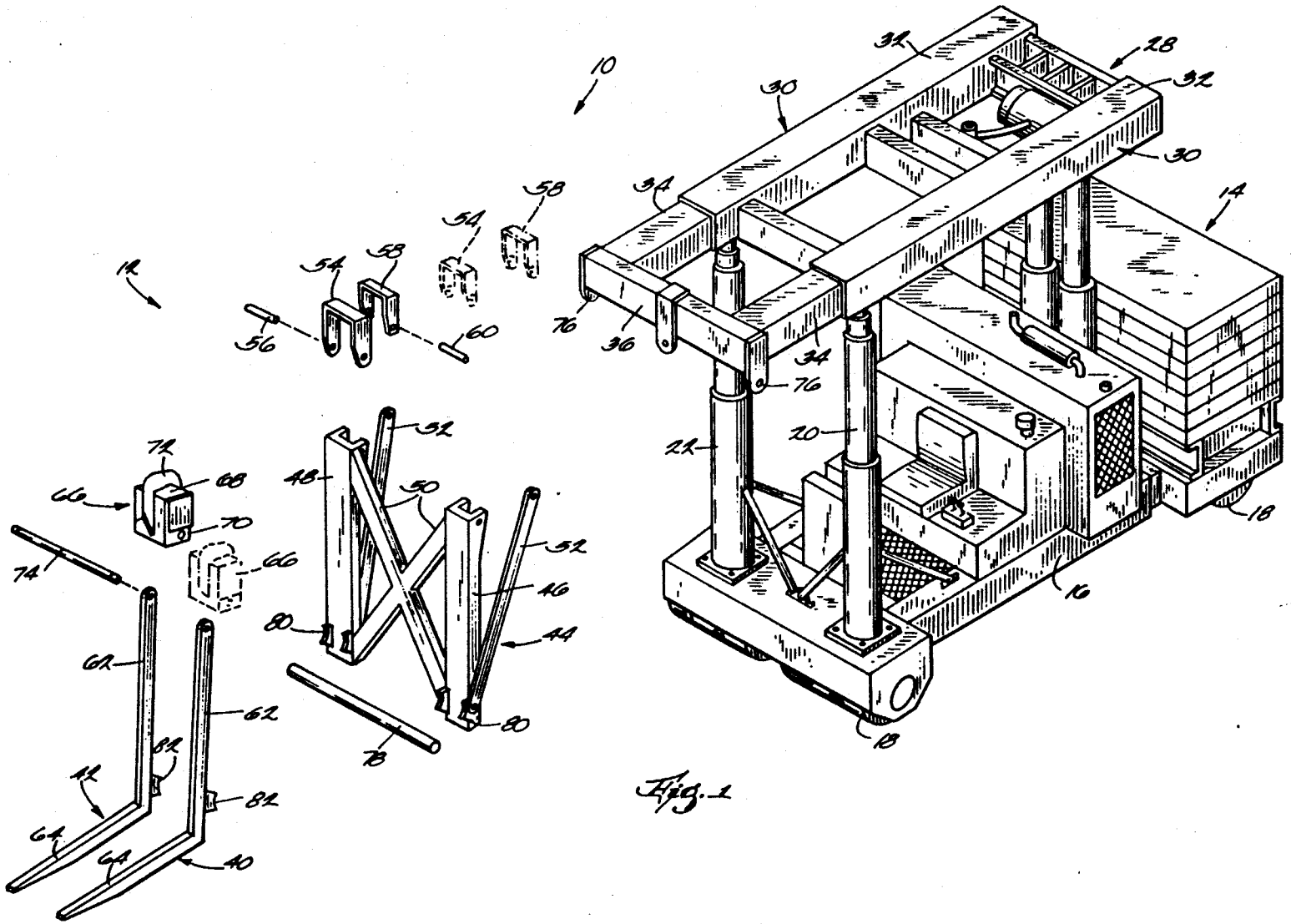
FIG. 1 is an exploded perspective view of a mobile lifting apparatus with fork attachment embodying various features of the invention.

Referring to the FIGS., a mobile lifting apparatus 10, including a fork attachment 12 and embodying various features of the invention, is illustrated. As best seen in FIG. 1, the mobile lifting apparatus 10 comprises a self propelled vehicle 14 configured for single-operator use. The mobile lifting apparatus 10 includes a wheeled chassis 16 having a plurality of rollers 18 at each end. A plurality of vertically oriented hydraulic cylinders 20, 22, 24, 26 extend upwardly from the chassis 16 and support a substantially horizontally oriented extendable boom assembly 28. The extendable boom assembly 28 comprises a pair of substantially parallel extendable booms 30, each having a relatively stationary portion 32 and a forwardly directed extendable portion 34. A forward cross beam 36 extends perpendicularly across the forwardmost ends of the extendable portions 34 of the booms 30. Hydraulic cylinders (not shown) within the booms control 30 the extension and retraction of the booms 30 in the horizontal direction.

In the illustrated embodiment, four vertical hydraulic cylinders 20, 22, 24, 26 are provided for supporting the boom assembly 28. The hydraulic cylinders are arranged in pairs, two 20, 22, adjacent the front of the mobile lifting apparatus and two 24, 26 at the rear. In operation, the two forward cylinders 20, 22 provide a lifting force on the boom assembly 28 to lift loads rigged to the forward end of the boom assembly 28. At the same time, the cylinders 24, 26 to the rear of the mobile lifting apparatus 10 exert a downward force on the boom assembly 28 to counteract the torque developed by the downward force of the load (not shown) and the upward force of the forward cylinders 20, 22. A prime mover, such as a gasoline, propane or diesel operated internal combustion engine 38, is provided for driving the mobile lifting apparatus 10 and powering the various hydraulic cylinders. The construction and operation of the mobile lifting apparatus 10 is described in U.S. Pat. No. 4,763,800 issued to Edgar D. Engler, et al. on Aug. 16, 1988, the specification of which is incorporated herein by reference.

Figure 2:
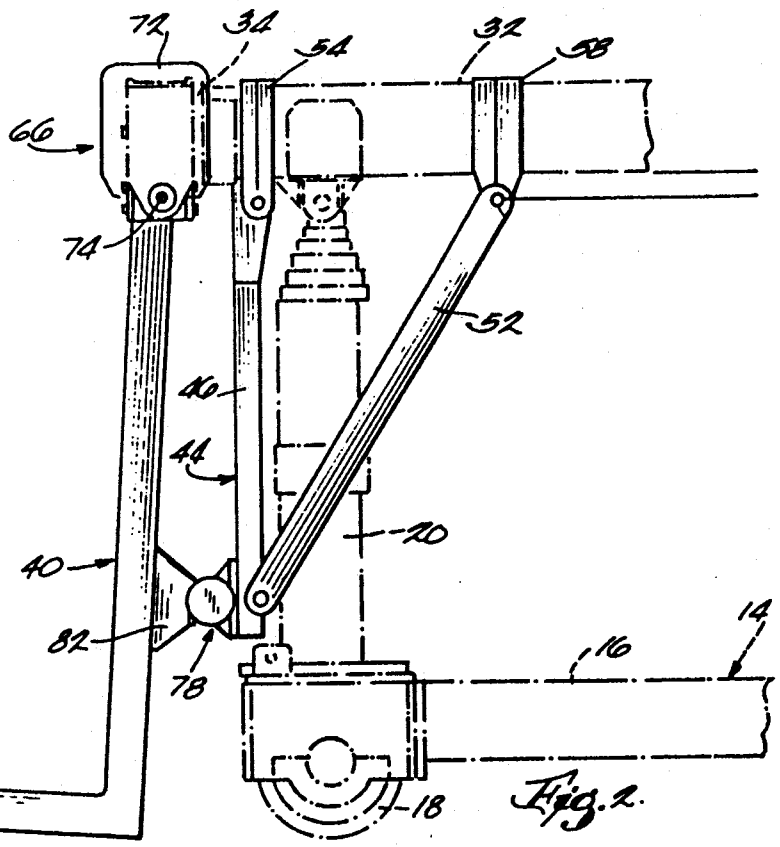
FIG. 2 is a fragmentary side elevation view of the mobile lifting apparatus shown in FIG. 1.
Figure 3:
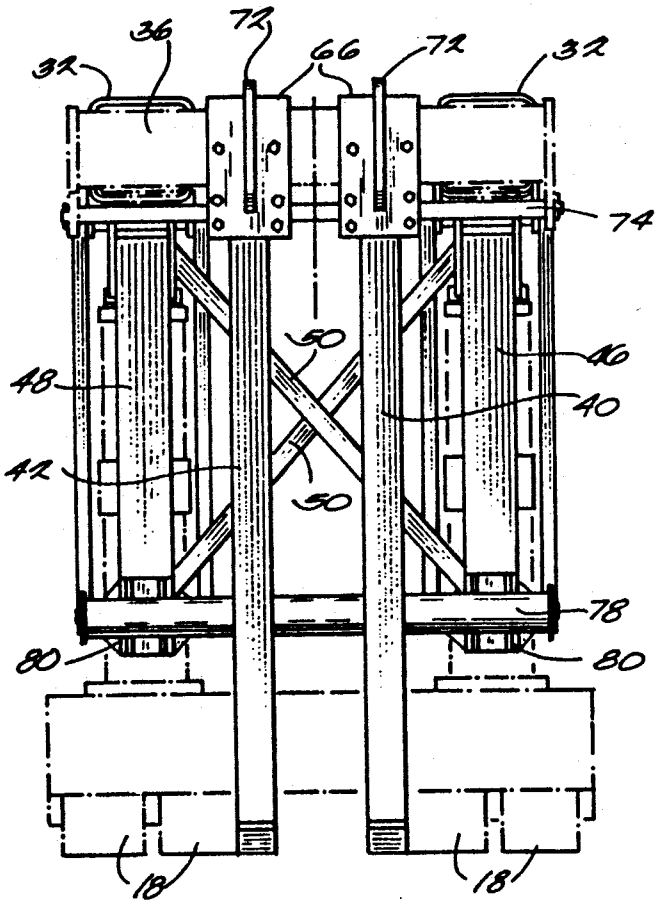
FIG. 3 is a front elevation view of the mobile lifting apparatus shown in FIGS. 1 and 2.

In accordance with one aspect of the invention, the mobile lifting apparatus 10 is provided with a fork attachment 12 that enables the apparatus 10 to lift and transport palletized loads. Referring further to FIGS. 1, 2 and 3, the fork attachment 12 generally includes a pair of forks 40, 42 and a buttress assembly 44 that can be attached to the forward end of the boom assembly 28. The buttress assembly 44, which is preferrably formed of welded heavy gauge steel, includes a pair of vertical, parallel, side members 46, 48 that are rigidly joined to each other by a pair of diagonal cross members 50.

Preferrably, the spacing between the side members 46, 48 of the buttress assembly 44 is substantially equal to the horizontal spacing between the forward cylinders 20, 22 of the mobile lifting apparatus 10.

The buttress assembly 44 further includes a pair of support arms 52 on either side. The support arms 52, which are also preferrably formed of rigid heavy gauge steel, are pivotally joined at one end to the lower ends of the buttress assembly side members46, 48. As best seen in FIG. 2, the upper ends of the buttress assembly side members 46, 48 and the remaining ends of the support arms are coupled to the relatively stationary portions 32 of the booms 30. The upper ends of the buttress assembly side members 52 are coupled to the booms 30 by means of individual, substantially U-shaped forward saddle assemblies 54 that are shaped and dimensioned to fit over the substantially rectangular-sectioned booms 30. The spaced lower ends of the saddles 54 are dimensioned to receive therebetween the upper ends of the buttress assembly side members 46, 48 which, in turn, are pivotally connected to the saddles 54 by means of transverse pins 56. The remaining or upper ends of the support arms 52 are coupled to the booms 30 by means of similar saddles 58 and pins 60. As best seen in FIG. 2, the individual saddles 54, 58, in conjunction with the booms 30 and the support arms 52, provide a rigid three point or triangular configuration that holds the buttress assembly 44 rigid relative to the remainder of the mobile lifting apparatus 10. Preferrably, the individual saddles 54, 58 can be positively affixed to the booms 30 by bolting or otherwise to provide further rigidity and stability to the buttress assembly 44.

In further accordance with the invention, the forks 40, 42 are mounted to the forward end of the movable portions 34 of the booms 30 so as to project forwardly from the mobile lifting apparatus 10. As illustrated, each fork 40, 42 comprises a generally L-shaped member having a substantially vertical upper portion 62 and a substantially horizontal lower portion 64. The two forks 40, 42 are substantially identical and are oriented in parallel spaced relationship to each other.

The uppermost ends of the forks 40, 42 are pivotally joined to the forward cross member 36 of the boom assembly 28 by means of individual forward saddle assemblies 66. Each saddle assembly 66 includes a saddle 68 extending over and around the substantially rectangular-sectioned forward cross member 36 and further includes a pair of support blocks 70 extending transversly across the lower, open ends of the saddle 68. An open space is left between the support blocks 70 sufficient to receive therein the uppermost end of a fork 40, 42. The support blocks 70 are removably bolted to the saddle 68 so as to facilitate installation onto the boom assembly 28. A perpendicularly extending flange 72 or stiffener extends around the three sides of the saddle 68 to provide additional rigidity and strength. Preferably, the forward saddle assemblies 66 are bolted to the forward cross member 36 to provide additional rigidity and strength.

As best seen in FIG. 3, the two forward saddle assemblies 66 are mounted in spaced relationship along the forward cross member 36 of the boom assembly 28. The upper ends of the individual forks 40, 42 are received within the saddle assemblies 66 and are retained in position by a horizontal cross shaft 74 extending transversely through appropriately shaped and located apertures in the saddle support blocks 70 and the fork upper ends. In the illustrated embodiment, the cross shaft 74 extends across the full width of the boom assembly 28 between the rigging points or eyes 76 ordinarily located adjacent the forward corners of the boom assembly 28.

In further accordance with the invention, means are provided for controllably tilting the forks 40, 42 so as to facilitate engagement and disengagement with the palletized load. To this end, a horizontal pivot rod 78 is mounted across the lower ends of the buttress assembly side members 46, 48 and is supported by means of a pair of support flanges 80 projecting forwardly from each side member 46, 48. An additional flange 82 projects rearwardly from the vertical portion 62 of each fork 40, 42 and includes an arcuate surface dimensioned to receive and engage the generally cylindrical pivot rod 78. As best seen in FIG. 2, the pivot rod 78 in connection with the flanges 80, 82 provides a pivot between the forks 40, 42 and the buttress assembly 44. Pivoting movement of the forks 40, 42 relative to the buttress assembly 44 changes the angular position of the forks 40, 42 relative to horizontal to facilitate engagement and disengagement with the palletized load. The angular position of the forks 40, 42 is controlled by the horizontal extension of the booms 28. As the boom 28 extends, the forks 40, 42 pivot counterclockwise as viewed in FIG. 2 causing the tips of the forks 40, 42 to tilt downwardly. Retraction of the boom 28 pivots the forks in the opposite or clockwise direction tilting the forward ends of the forks upwardly. Once a palletized load is engaged and lifted slightly off the ground by retracting the boom, the vertical hydraulic cylinders 20, 22, 24, 26 can be actuated to lift the load vertically above the ground. Thereafter, the mobile lifting apparatus 10 can be driven to transport the load as desired. Upon reaching the final destination, the vertical cylinders can be retracted to lower the load. The boom can then be extended slightly while the mobile lifting apparatus is backed away to lower the fork tips and thereby disengage the load.

The fork attachment disclosed herein provides a useful and low cost means for providing a fork truck capability to a mobile lifting device of the "boom truck" type. Because the fork attachment is removable, the ability of the machine to perform its ordinary tasks is not impaired.

It will be appreciated by those skilled in the art that the materials used in the construction of the fork attachment, and the dimensions used in the various components and connections, therein will be selected so as to withstand the anticipated loads and forces. Although a specific configuration for the fork attachment has been shown and described, it will be appreciated by those skilled in the art that alternative configuratons can be utilized.

While a particular embodiment of the invention has been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

We claim:

1. A mobile lifting apparatus comprising:

a wheeled chassis;

a plurality of substantially vertically oriented hydraulic cylinders mounted on said chassis;

a pair of substantially horizontal, substantially parallel extendable booms supported by said vertically oriented hydraulic cylinders each of said booms including a relatively stationary portion and a relatively extendable portion;

an engine for driving said wheeled chassis and powering said hydraulic cylinders and said extendable booms; and a fork attachment supported by said extendable booms, said fork attachment including:

a substantially vertical buttress assembly having an upper end coupled to said relatively stationary portions of said booms and having a lower end below said upper end;

a substantially horizontal pivot rod mounted adjacent said lower end of said buttress assembly;

a pair of fork arms, each of said fork arms including a substantially vertical portion having an upper end and a lower end and further including a substantially horizontal portion extending from said lower end of said vertical portion;

said upper ends of said vertical portions of said fork arms being pivotally attached to said relatively extendable portions of said booms so that said fork arms depend downwardly from said booms; and each of said fork arms further including a pivot flange adjacent said lower end of said vertical portion for engaging said pivot rod so that each of said fork arms is pivotable over a limited angular range around said pivot rod and so that an angular position of said fork arms around said pivot rod is controlled by an extension and retraction of said booms.

2. In a mobile lifting apparatus having a wheeled chassis, a plurality of hydraulic cylinders extending upwardly from the chassis, a pair of extendable booms each having a relatively stationary portion and a relatively extendable portion carried on and supported by the hydraulic cylinders and an engine for driving the chassis and powering the hydraulic cylinders and the extendable booms, the improvement comprising a fork attachment operable to engage and raise a palletized load, said fork attachment comprising:

a substantially vertical buttress assembly having an upper end mountable to the relatively stationary portions of the booms and having a lower end below said upper end;

a substantially horizontal pivot rod mounted adjacent said lower end of said buttress assembly;

a pair of fork arms, each of said fork arms including a substantially vertical portion having an upper end and a lower end and further including a substantially horizontal portion extending from said lower end of said vertical portion;

said upper ends of said vertical portions of said fork arms being pivotally attachable to the relatively extendable portions of the booms so that said fork arms depend downwardly from the booms when said upper ends are attached to the relatively extendable portions of the booms; and each of said fork arms further including a pivot flange adjacent said lower end of said vertical portion for engaging said pivot rod so that each of said fork arms is pivotable over a limited angular range around said pivot rod and so that an angular position of said fork arms around said pivot rod is controlled by an extension and retraction of the booms.

3. A fork attachment for a mobile lifting apparatus of the type having a pair of extendable booms each having a relatively stationary portion and a relatively extendable portion supported by a plurality of substantially vertical hydraulic cylinders, said fork attachment comprising:

a substantially vertical buttress assembly having an upper end mountable to the relatively stationary portions of the booms and having a lower end below said upper end;

a substantially horizontal pivot rod mounted adjacent said lower end of said buttress assembly;

a pair of fork arms, each of said fork arms including a substantially vertical portion having an upper end and a lower end and further including a substantially horizontal portion extending from said lower end of said vertical portion;

said upper ends of said vertical portions of said fork arms being pivotally attachable to the relatively extendable portions of the booms so that said fork arms depend downwardly from the booms when said upper ends are attached to the relatively extendable portions of the booms; and each of said fork arms further including a pivot flange adjacent said lower end of said vertical portion for engaging said pivot rod so that each of said fork arms is pivotable over a limited angular range around said pivot rod and so that an angular position of said fork arms around said pivot rod is controlled by an extension and retraction of the booms.

* * * * *